US012433457B1

(12) United States Patent
Jones

(10) Patent No.: US 12,433,457 B1
(45) Date of Patent: Oct. 7, 2025

(54) WARM DISPOSABLE TOILET SEAT COVER

(71) Applicant: Jacob Jones, Scotrun, PA (US)

(72) Inventor: Jacob Jones, Scotrun, PA (US)

( * ) Notice: Subject to any disclaimer, the term of this patent is extended or adjusted under 35 U.S.C. 154(b) by 0 days.

(21) Appl. No.: 16/128,739

(22) Filed: Sep. 12, 2018

(51) Int. Cl.
*A47K 13/14* (2006.01)

(52) U.S. Cl.
CPC ..... *A47K 13/14* (2013.01)

(58) Field of Classification Search
CPC ..... A47K 13/30; A47K 13/305; A47K 13/14; A47K 13/16; A61F 7/03; A61F 7/032; A61F 7/034
USPC ..... 4/245.1
See application file for complete search history.

(56) References Cited

U.S. PATENT DOCUMENTS 1,159,070 A 11/1915 Munch
5,642,531 A 7/1997 Holtom et al.
5,987,656 A * 11/1999 Kakutani ..... A47K 13/14 4/245.3
6,074,413 A * 6/2000 Davis ..... A61F 7/03 607/108
6,996,859 B1 * 2/2006 Alonso ..... A47K 13/14 4/244.1
7,247,360 B1 7/2007 Besner et al.
D605,262 S 12/2009 Rodgers
7,875,066 B2 * 1/2011 Cohen ..... A61F 7/02 607/108
8,373,096 B2 2/2013 Tsai et al.
8,973,175 B2 3/2015 Green
9,339,157 B2 5/2016 Sarker
D783,788 S 4/2017 Taylor
2005/0228466 A1 * 10/2005 Harris ..... A61F 7/03 607/114
2012/0222204 A1 * 9/2012 Blake ..... A47K 13/14 4/245.6

FOREIGN PATENT DOCUMENTS

CN 203088983 U * 7/2013
CN 204218802 U * 3/2015

OTHER PUBLICATIONS

CN303088983 English translation (Year: 2013).*
CN204218802 English translation (Year: 2015).*

* cited by examiner

*Primary Examiner* — David P Angwin
(74) *Attorney, Agent, or Firm* — Vincent G. LoTempio; Robert L. Cerasa

(57) ABSTRACT

A warm disposable toilet seat cover includes a self-heating toilet seat cover that is capable of being removably secured to an upper exterior surface of a toilet seat.

12 Claims, 3 Drawing Sheets

WARM DISPOSABLE TOILET SEAT COVER

RELATED APPLICATIONS

Non-applicable.

FIELD OF THE INVENTION

The presently disclosed subject matter is directed to warm disposable toilet seat covers.

BACKGROUND OF THE INVENTION

Everyday, millions of people must make use of a toilet and a common complaint is that oftentimes the toilet seat is cold. Normally, a user must simply endure the discomfort of a cold toilet seat until it has been sufficiently warmed by body contact to no longer be noticeable or uncomfortable.

Solutions to this problem are widely available and typically take the form of an electrically heated toilet seat. While this solution is effective it may not be economically well suited for most consumers who dislike a cold toilet seat but regard the same as merely a nuisance not warranting the expenditure associated with an electrically heated toilet seat. The present invention effectively addresses this concern by providing a cost effective chemical heat source with a toilet seat cover that is disposable.

SUMMARY OF THE INVENTION

The principles of the present invention provide for a disposable toilet seat cover comprising a ring shaped cover comprising a pair of coterminous sheets which are bonded together and share a perimeter while defining an interior void. The cover further comprises a top side, a bottom side, an adhesive layer which is secured to an exterior surface of the bottom side, a front side, a rear side which is opposite the front side and a central opening. The cover also further comprises an air activated thermal activation media which is secured within the interior void. The adhesive layer is capable of being removably secured to an upper surface of a toilet seat. Additionally, when activated, the thermal activation media increases in temperature.

The pair of coterminous sheets may be air permeable. The top side may comprise a beveled and arcuate perimeter. A removable backing paper may be disposed upon the adhesive layer while the rear side may be linear.

The air activated thermal activation media may comprise in part a portion of iron, vermiculite, activated charcoal, salt and a filler material. When the thermal activation media is exposed to air, the thermal activation media undergoes an irreversible exothermic reaction. The air activated thermal activation media may further comprises as a percentage by weight fifty percent iron, ten percent activated charcoal, five percent vermiculite, five percent water-absorbent resin, five percent sodium chloride and twenty-five percent water.

The cover may come in an air impermeable outer packaging while the adhesive layer may be coterminous with the bottom side. The central opening may have the diameter of a toilet seat opening upon which the seat cover is secured.

An alternate embodiment of the device may comprise coterminous sheets being made of vinyl and a thermal activation media comprising sodium acetate. This configuration allows for a reusable heat source. The sodium acetate solution may comprise one part water to one and one quarter parts sodium acetate.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
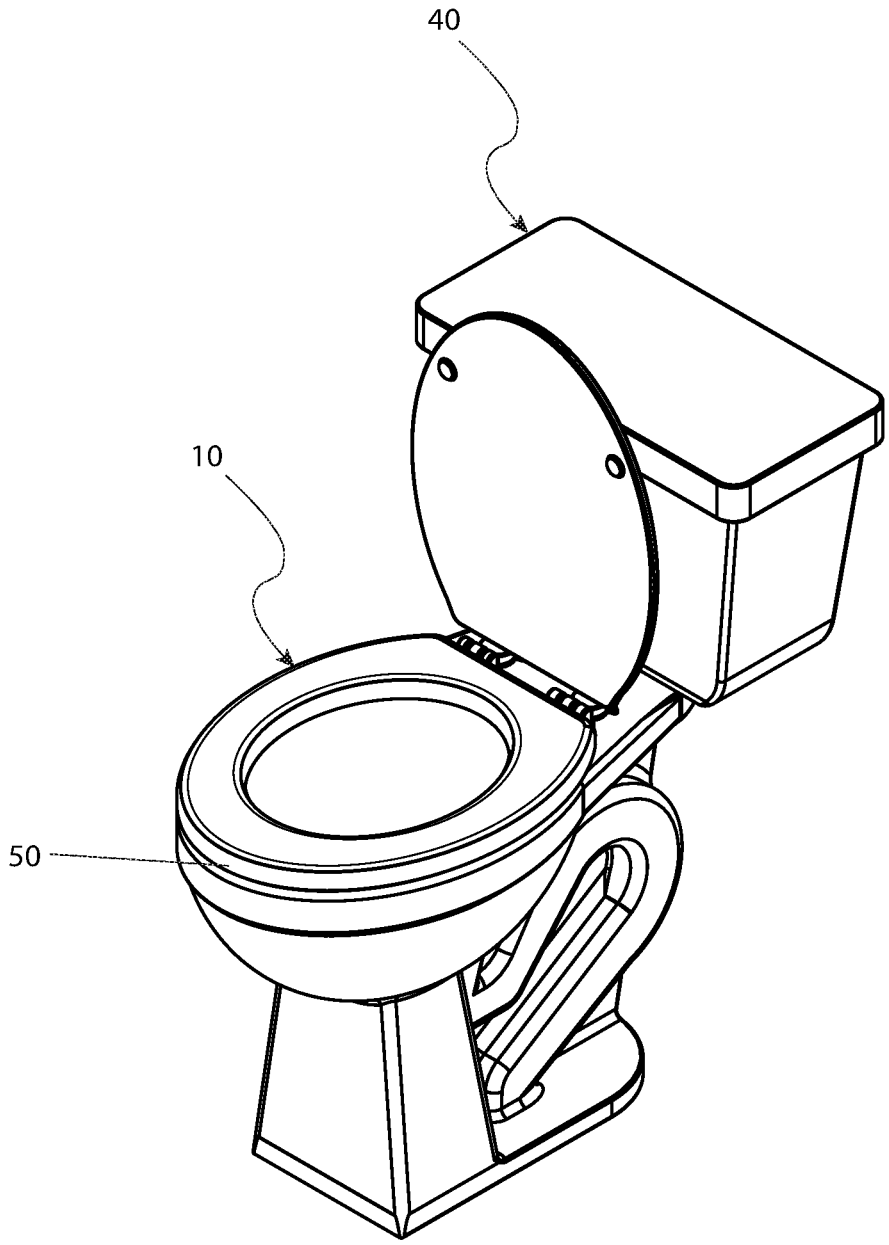
FIG. 1 is an environmental front perspective view of the warming seat cover 10 placed on a toilet seat 50 of a toilet 40, according to the preferred embodiment of the present invention.

10 warming seat cover
11 top side
12 thermal activation media
13 front side
14 rear side
15 center opening
16 bottom side
20 adhesive layer
21 backing
30 packaging
40 toilet
50 toilet seat

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a perspective environmental view of the warming seat cover (herein described as the "cover") 10, as installed in a preferred method of use of a toilet seat 50 of a toilet 40. The size and shape of the cover 10 is preferably of a single size that is capable of fitting over most conventional toilet seats 40. The cover 10 includes thermal activation media 12 retained there within, which is capable of being activated to provide a warming effect for a pre-determined period.

Figure 2:
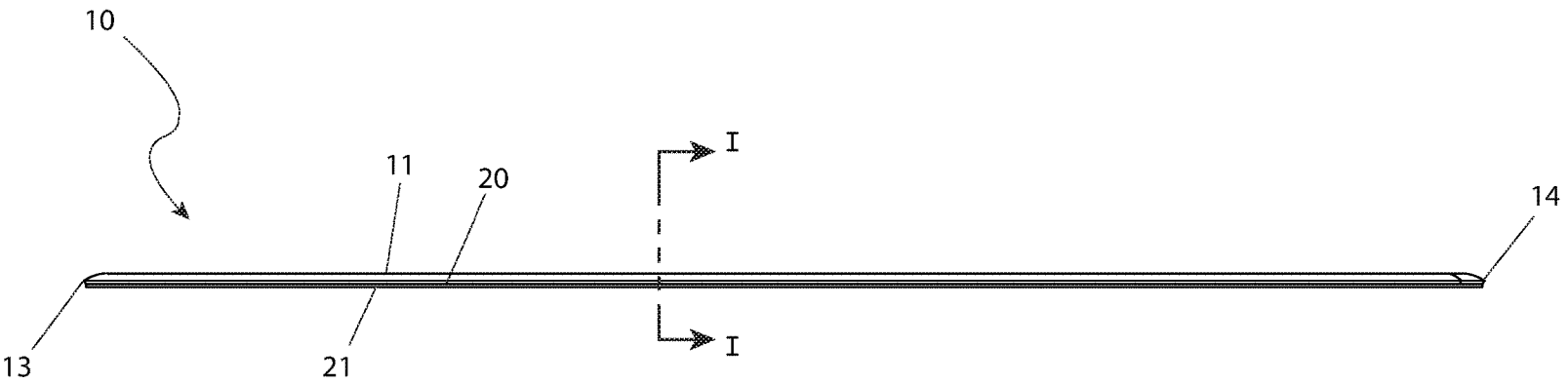
FIG. 2 is a side elevation view of the warming seat cover 10, according to the preferred embodiment of the present invention.
Figure 3:
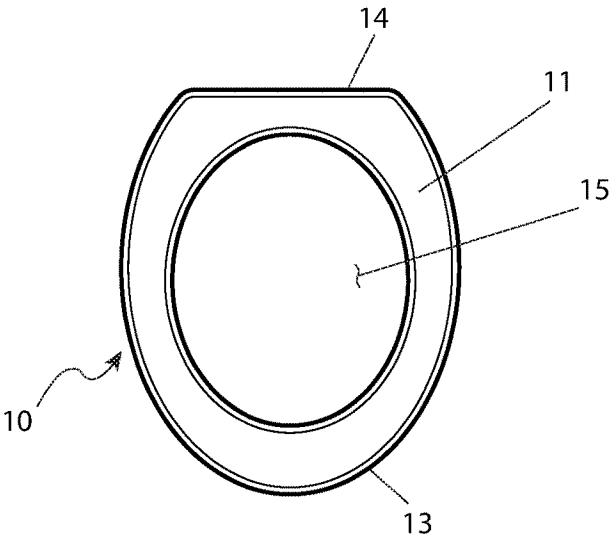
FIG. 3 is a top plan view of the warming seat cover 10, according to the preferred embodiment of the present invention.
Figure 4:
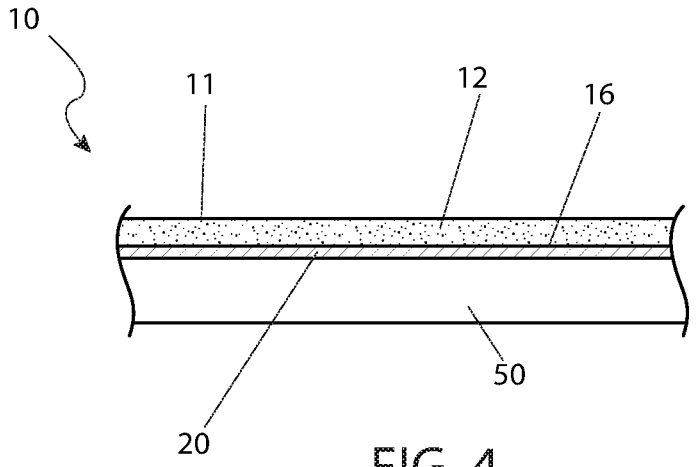
FIG. 4 is a cut-away view of the warming seat cover 10 along the line I-I (see FIG. 2), according to the preferred embodiment of the present invention; and, FIG. 5 is an environmental perspective view of the warming seat cover 10 retained within packaging 30, according to a preferred use of the present invention.

Referring now to FIGS. 2-4, there is illustrated a cover 10 having an overall general shape, size, and profile to cover the upper surface of a toilet seat 40. Preferably, the cover 10 is a pair of air-permeable coterminous sheets bonded together about shared perimeters to define a void therebetween. The cover 10 has a top side 11, a bottom side 16 comprising an adhesive layer 20, a front side 13, a rear side 14, and a center opening 15. The top side 11 can have a slightly beveled perimeter edge that is generally arcuate to eliminate or greatly reduce unintended snagging of clothing, skin, or items, and to also aid in sitting on and departing from the cover 10. The adhesive layer 20 may be coterminous with the entire bottom side, or any portion thereof. The adhesive layer 20 may be protected with a backing 21 that can be removed once the cover 10 is ready to be used. The adhesive layer 20 is capable of removable adherence of the cover 10 to the toilet seat 40 to restrict movement of the cover 10 relative to the toilet seat 40. The adhesive layer 20 has a bond strength that can be easily defeated (i.e., not strong enough to permanently bond or mar the surface of the toilet seat 40). The front side 13 is generally curved so as to match the contour of a conventional toilet seat 40 and the rear side 14 is preferably linear so as to not interfere with mounting hardware for the toilet seat 40 to the upper rim of the bowl of the toilet 50. The sides of the cover 10 also generally match the contour and profile of a conventional toilet seat 40 and are curvilinear in a convex profile with respect to a bisecting centerline passing through the front side 13 and rear side 15. The center opening 15 is also generally matching that center opening of the toilet seat 40 to enable body waste to pass through both the center opening 15 of the cover 10 and the center opening of the toilet seat 40.

Figure 5:
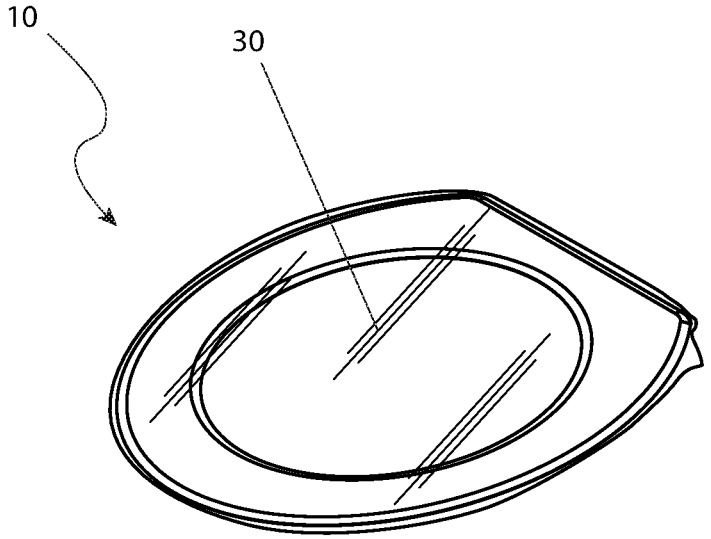

Referring more closely to FIG. 4, which shows a cut-away for the preferred embodiment of the cover 10, it is clearly seen that the interior void of the cover 10 itself is filled with thermal activation media 12. The interior void may be either partially or fully filled with the thermal activation media 12. The thermal activation media 12 can fill the majority of the void, or some other portion thereof, to provide a warming effect due to an exothermic reaction that provides a known amount of thermal energy for a known period of time. Such an exothermic reaction can be instigated by physical manipulation of a catalyst or mere exposure to the air. FIG. 5 illustrates the preferred method of use of the cover 10, wherein the entire cover 10 is retained within packaging 30 that restricts exposure to air. Once the cover 10 is removed from the packaging 30, the thermal activation media 30 is exposed to air and the exothermic reaction propagates. In certain embodiments, the thermal activation media 12 can provide thermal energy in an irreversible manner and that can include similar chemicals in similar amounts as an air-activated hand warmer, which includes iron (Fe), vermiculite ((Mg, Fe+2, Fe+3)3[(Al, Si)4O10](OH)2·4H2O), activated charcoal (Ca), salt (NaCl), and filler. Other embodiments may utilize a supersaturated solution such as sodium acetate with a nucleation center such as a metallic disk, which provides thermal energy in a reversible manner, thereby enabling reuse. The preferred supersaturated solution comprises approximately one part water to one and one quarter parts sodium acetate. In this configuration the cover 10 would comprises vinyl or a similarly liquid impermeable material. The amount and type of thermal activation media 12 can dictate the desired amount of thermal energy delivered and the period with which is delivered. In an exemplary embodiment, the thermal activation media 12 is provided in approximately one hundred sixty grams (160 g) and constitutes approximately fifty percent (50%) of iron (Fe) powder, ten percent (10%) of activated charcoal (Ca), five percent (5%) of vermiculite ((Mg, Fe+2, Fe+3)3[(Al, Si)4O10](OH)2·4H2O, five percent (10%) of sodium chloride (NaCl), five percent (5%) of a water-absorbent resin, and twenty-five percent (25%) of water (H2O). The material of the cover 10 can be varied to provide the amount and period of thermal transfer.

Other embodiments are envisioned that fall under the scope of the present invention, which can include other means of removably attaching the cover 10 to the toilet seat 40, such as elastic bands.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A disposable toilet seat cover, comprising:

a ring shaped cover comprising a pair of coterminous sheets bonded together sharing a perimeter and defining an interior void, further comprising:

a top side;

a bottom side;

an adhesive layer secured to an exterior surface of said bottom side;

a front side;

a rear side opposite said front side; and a central opening;

an air activated thermal activation media secured fully filled within said interior void;

a removable backing paper disposed upon said adhesive layer;

wherein said adhesive layer is capable of being removably secured to an upper surface of a toilet seat; and wherein said interior void extends the entirety of the ring shaped cover;

wherein when activated, said thermal activation media increases in temperature;

wherein said pair of coterminous sheets are air permeable;

wherein said top side comprises a beveled and arcuate perimeter; and wherein said rear side is linear.

2. The seat cover of claim 1, wherein said air activated thermal activation media comprises in part iron, vermiculite, activated charcoal, salt and a filler material;

wherein when said thermal activation media is exposed to air, said thermal activation media undergoes an irreversible exothermic reaction.

3. The seat cover of claim 1, wherein said air activated thermal activation media further comprises as a percentage by weight:

fifty percent iron;

ten percent activated charcoal;

five percent vermiculite;

five percent water-absorbent resin;

five percent sodium chloride; and, twenty-five percent water.

4. The seat cover of claim 1, comprising air impermeable outer packaging.

5. The seat cover of claim 1, wherein said adhesive layer is coterminous with said bottom side.

6. The seat cover of claim 1, wherein said central opening matches the diameter of a toilet seat opening upon which said seat cover is secured.

7. A disposable toilet seat cover comprising:

a ring shaped cover comprising a pair of coterminous sheets bonded together sharing a perimeter and defining an interior void, further comprising:

a top side;

a bottom side;

an adhesive layer secured to an exterior surface of said bottom side;

a front side;

a rear side opposite said front side; and a central opening;

a chemically activated thermal activation media secured fully filled within said interior void;

a removable backing paper disposed upon said adhesive layer;

wherein said adhesive layer is capable of being removably secured to an upper surface of a toilet seat; and wherein when activated, said thermal activation media increases in temperature;

wherein said interior void extends the entirety of the ring shaped cover;

wherein said pair of coterminous sheets are vinyl;

wherein said top side comprises a beveled and arcuate perimeter, and wherein said rear side is linear.

8. The seat cover of claim 7, wherein said chemically activated thermal activation media comprises sodium acetate and a nucleation center;

wherein when said nucleation center is depressed, said chemically activated thermal activation media undergoes a reversible exothermic reaction.

9. The seat cover of claim 8, wherein said chemically activated thermal activation media further comprises as a percentage by volume:

one part water; and one and one quarter part of sodium acetate.

10. The seat cover of claim 8, wherein said nucleation center comprises a metallic disk.

11. The seat cover of claim 7, wherein said adhesive layer is coterminous with said bottom side.

12. The seat cover of claim 7, wherein said central opening matches the diameter of a toilet seat opening upon which said seat cover is secured.

* * * * *